US006371428B1

(12) United States Patent
Zorich et al.

(10) Patent No.: US 6,371,428 B1
(45) Date of Patent: Apr. 16, 2002

(54) COLLAPSIBLE BEVERAGE CONTAINER HOLDING DEVICE

(76) Inventors: Michael S. Zorich, 1176 LaSalle Rd., Monroeville, PA (US) 15146; Jeffrey Ross Scarcelli, 705 7th St., Trafford, PA (US) 15085

( * ) Notice: Subject to any disclaimer, the term of this patent is extended or adjusted under 35 U.S.C. 154(b) by 0 days.

(21) Appl. No.: 09/504,454

(22) Filed: Feb. 16, 2000

Related U.S. Application Data

(60) Provisional application No. 60/120,166, filed on Feb. 16, 1999.

(51) Int. Cl.[7] ..... A47K 1/08

(52) U.S. Cl. ..... 248/311.2; 206/549; 224/414; 248/309.1

(58) Field of Search ..... 248/311.2, 310, 248/312.1, 313, 309.1; 206/194, 427, 549; 224/413, 414, 444, 459

(56) References Cited

U.S. PATENT DOCUMENTS 3,692,228 A * 9/1972 Spiegel ..... 229/29 F
4,275,862 A * 6/1981 Takagi et al. ..... 248/205 R
4,984,722 A * 1/1991 Moore ..... 224/42.43
5,297,767 A * 3/1994 Miller et al. ..... 248/311.2
5,713,546 A * 2/1998 Auspos ..... 248/311.2
5,803,264 A * 9/1998 Gersten et al. ..... 206/549
5,957,276 A * 9/1999 Cutler et al. ..... 206/194
6,068,127 A * 5/2000 Hunter ..... 206/549
6,176,405 B1 * 1/2001 Roach ..... 224/414

* cited by examiner

*Primary Examiner*—Ramon O. Ramirez
*Assistant Examiner*—Tan Le
(74) *Attorney, Agent, or Firm*—Webb Ziesenheim Logsdon Orkin & Hanson, P.C.

(57) ABSTRACT

A collapsible beverage container holder is designed to facilitate the ability to position the holder conveniently and securely at a seat or couch cushion or bed mattress level. The holder is designed to be packaged as a flat folded piece of material, typically plastic or the like, that can be unfolded and assembled in a simple fashion. Once assembled, a mounting portion of the base is slid under the seat or couch cushion or bed mattress with the beverage receiving portion protruding therefrom.

11 Claims, 3 Drawing Sheets

COLLAPSIBLE BEVERAGE CONTAINER HOLDING DEVICE

This application claims the benefit of U.S. Provisional Patent Application Ser. No. 60/120,166 entitled "Plastic Piece for Advertisement" and filed on Feb. 16, 1999, which is incorporated herein by reference.

BACKGROUND OF THE INVENTION

1. Field of the Invention

The present invention relates to beverage container holding devices. More specifically, the present invention is directed toward a collapsible beverage holder that facilitates the holding of a beverage conveniently adjacent a couch or seat cushion or bed mattress.

2. Prior Art

Beverage container holding devices, also called can holding devices and cup holders, have been developed for use in a variety of areas. For example, beverage container holding devices have been incorporated in a variety of positions within automobiles. Additionally, furniture has been created which includes beverage or can holding compartments built into various locations or compartments within the furniture. This solution, however, does not always provide a cost-effective mechanism for providing a cup holder in the furniture. Furthermore, it does not address the ability of adding cup holders to existing furniture.

It is the object of the present invention to overcome the aforementioned difficulties of the prior art. Specifically, the present invention is designed to facilitate the ability to position a beverage holder securely and conveniently at the couch or seat cushion or bed mattress level. It is an object of the present invention to provide a beverage holder which is economical to manufacture and which can be easily, securely and removably positioned on a couch, a seat or a bed. It is a further object of the present invention to provide a beverage holder which can be easily packaged with associated beverages. It is a further object of the present invention to provide a collapsible beverage holder particularly adapted for advertising, promotional and/or marketing activities.

SUMMARY OF THE INVENTION

The above objects of the present invention are achieved with the collapsible beverage container holder according to the present invention. The collapsible beverage container holder according to the present invention includes a planar base extending longitudinally from a mounting end to a distal end with at least one beverage receiving aperture in the base adjacent the distal end. A first side is pivotally attached to the distal end and adapted to be moved to a position extending away from, possibly substantially perpendicular to, the planar base. A bottom is pivotally attached to an end of the first side and adapted to be moved to a position substantially parallel to the base opposed from the at least one beverage receiving opening. A second side is pivotally attached to one end of the bottom and adapted to be attached to the base at a position between the mounting end and the at least one beverage receiving opening.

The present invention can be designed to be packaged as a flat folded piece of material that can be unfolded and assembled. Once unfolded, the structure can be assembled and secured in place with the mounting end of the planar base slid under a couch or seat cushion or bed mattress to hold the device in position. In position, the leading or distal end of the planar base will protrude from the side of the seat, couch or bed exposing the beverage receiving opening for receipt and support of beverage containers therein.

The holder may be formed from plastic material, such as polypropylene and polyethylene, or may be formed of cardboard, wood, metal, fiberglass, plexiglass or any other conventional materials.

In one embodiment of the present invention, an end of the second side can include a locking tab receivable within a locking slot in the planar base for securing it together in the assembled position.

These and other advantages of the present invention will be clarified in the detailed description of the preferred embodiments together with the attached figures wherein like reference numerals represent like elements throughout.

DETAILED DESCRIPTION OF THE PREFERRED EMBODIMENTS

Figure 1:
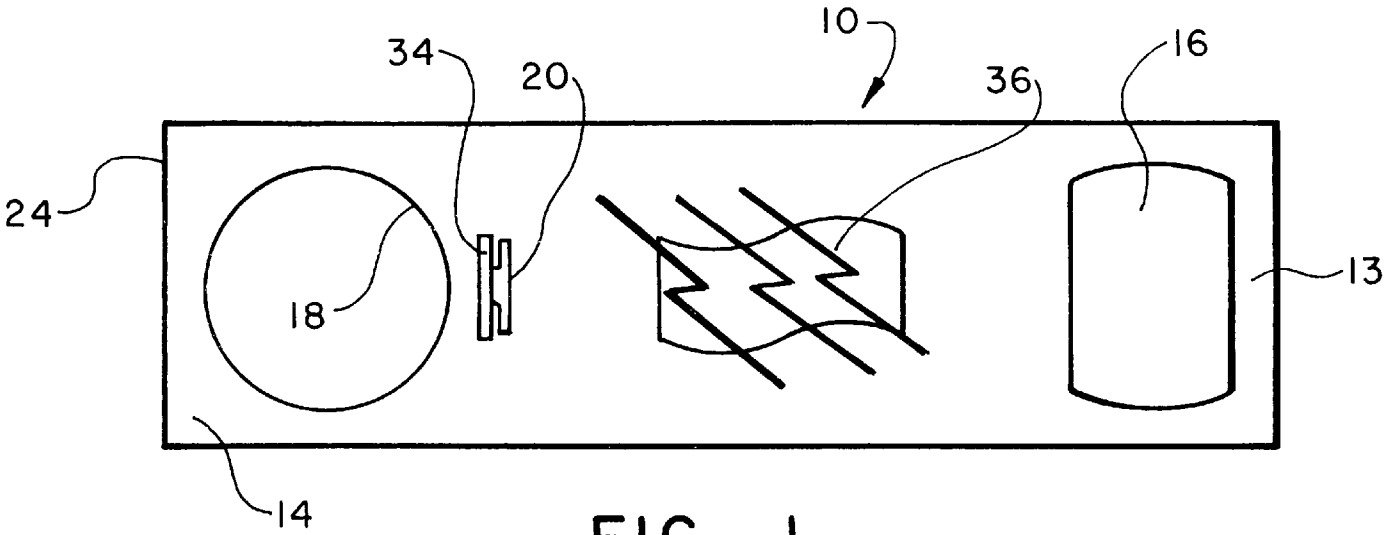
FIG. 1 is a plan view of an assembled collapsible beverage holder according to the present invention.
Figure 2:
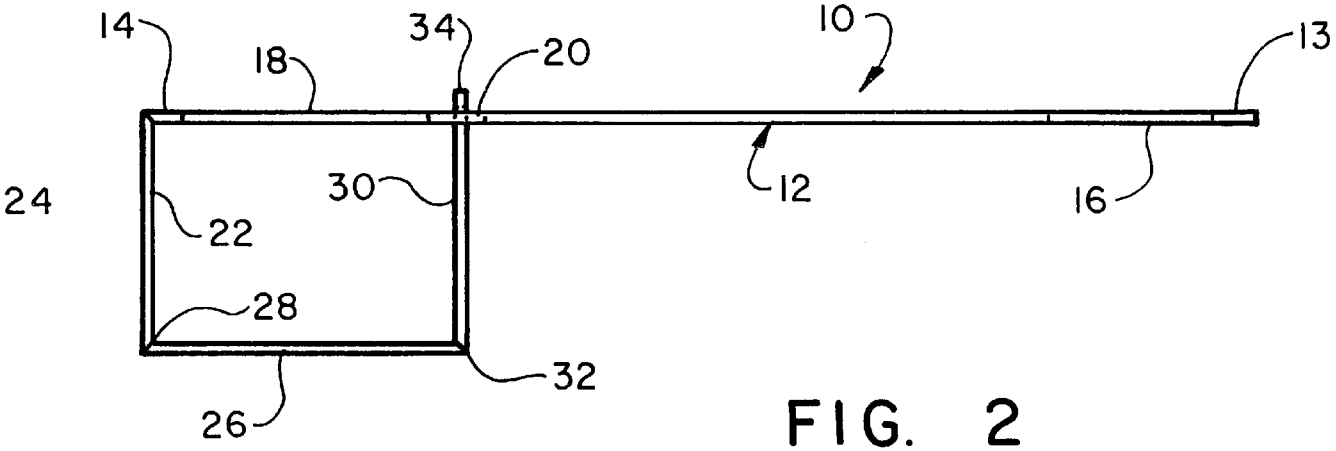
FIG. 2 is a side view of the holder illustrated in FIG. 1.

A collapsible beverage container holder 10 according to the present invention is illustrated in FIGS. 1 and 2 in the assembled position. The holder 10 is designed to facilitate the ability to position the holder 10 securely and conveniently at a couch or seat cushion or bed mattress level as will be described hereinafter. The holder 10 is designed to hold bottles, cans, glasses, or the like as known in the art.

Figure 3:
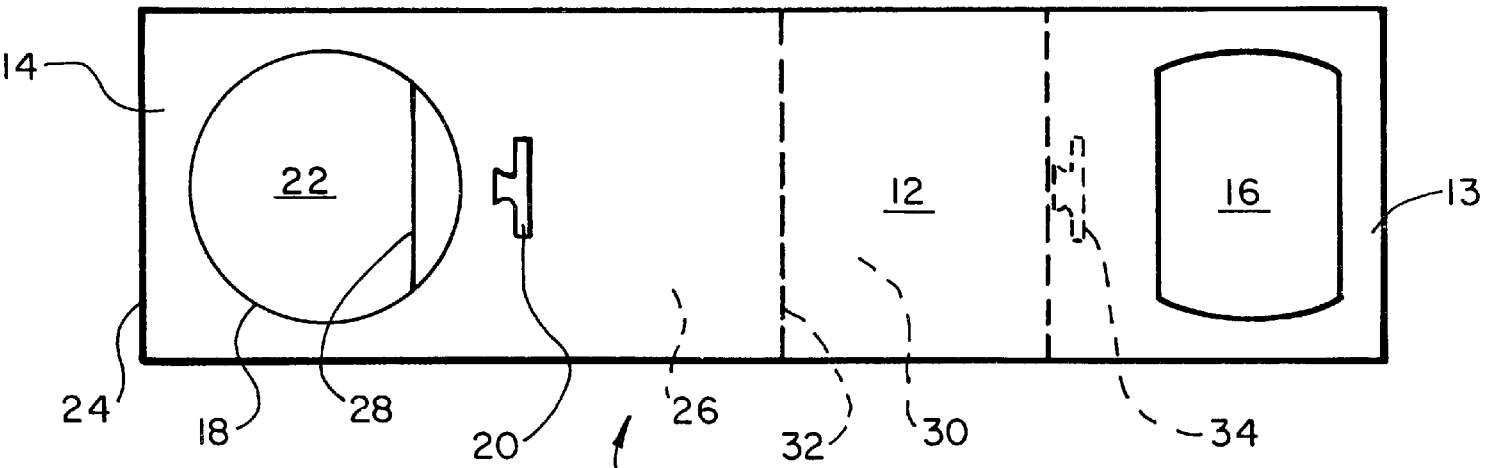
FIG. 3 is a plan view of the holder illustrated in FIGS. 1 and 2 in a stored position.

The holder 10 includes a planar substantially rectangular base 12 which extends longitudinally from a mounting end 13 to a distal end 14. The base 12 may include a handle opening 16 adjacent the distal end 14 which provides a position for easily grasping and moving the beverage holder 10 when not in use. The base 12 includes a beverage receiving aperture 18 adjacent the distal end 14 and a tab receiving locking notch 20 adjacent the beverage receiving aperture 18. The beverage receiving aperture 18 is sized to receive a conventionally sized beverage container, such as a 12 fluid ounce can or a 16 fluid ounce bottle. The notch 20 is best illustrated in FIGS. 3 and 5 and includes an elongated key receiving portion and a narrower tab receiving/locking portion, as shown.

A first side 22 is pivotally attached to the distal end 14 of the base 12 by a hinge 24. If the beverage holder 10 is formed out of plastic or associated material, the hinge 24 may be formed as a living hinge as known in the art. As shown in FIG. 2, in the assembled position, the first side 22 is positioned substantially perpendicular to the base 12.

A bottom 26 is pivotally attached to an end of the first side 22 by hinge 28 with the bottom adapted to be positioned substantially parallel with the base 12 and opposed from the beverage receiving aperture 18 in the assembled position. A second side 30 is pivotally attached to an end of the bottom 26 by hinge 32. In the assembled position, the second side 30 is parallel to the first side 22 and is adapted to be attached to the base 12 at a position between the mounting end 13 and the beverage receiving opening 18. Specifically, the second side 30 includes a T-shaped tab 34 which is adapted to be received and locked into the notch 20 of the base 12.

Figure 5:
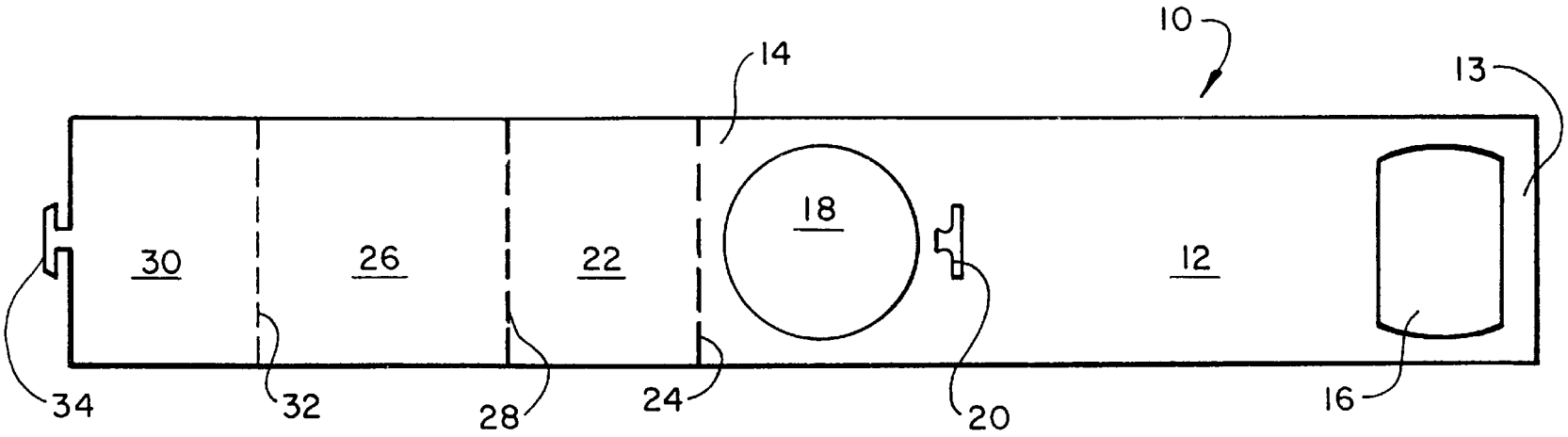
FIG. 5 is a plan view of an unassembled holder illustrated in FIGS. 1 and 2.

The holder 10 of the present invention is specifically designed to be formed from a single blank of material, as shown in FIG. 5. Additionally, the holder 10 is adapted to be moved from an unassembled position illustrated in FIGS. 5 and 6 to a folded or stored position in which the first side 22, the bottom 26 and the second side 30 are opposed from the base 12. This folded position provides that the holder 10 is particularly well adapted for storage and shipping. Additionally, this size allows the holder 10 to be easily incorporated into a conventional case of bottled or canned beer, soft drinks, or the like. A conventional case is 12 or 24 standard bottles or cans. It is anticipated that the holder 10 of the present invention can even be formed as part of the packaging of the beverages. For example, the holder 10 may be formed as a punch out portion of a cardboard box containing beverages. Incorporating the holder 10 of the present invention with a case of beverages to be held is a significant feature of the present invention. This, coupled with the extremely low cost of the present invention, allows the holder 10 to be adapted for a wide variety of promotional activities associated with a particular beverage manufacturer.

The holder 10 of the present invention can be economically manufactured from a wide variety of materials including various plastics, plexiglass, wood, metal, fiberglass or cardboard. Additionally, the present invention provides a significant amount of space on the base 12, first and second sides 22, 30 and the bottom 26 for printed indicia, specifically advertising, marketing and/or promotional material such as selected team logos or any of the like. A representative logo 36 is shown on base 12 in FIG. 1. This provides a significant amount of marketing abilities for the present invention. The present invention can be easily and economically manufactured and incorporated into existing packaging. Furthermore, the hinges 24, 28 and 32 can bend in either direction allowing for reversing of the exposed sides of the base 12, sides 22, 30 and bottom 36. This reversing allows the user to selectively display the selected items. For example, the logos of opposing teams or conferences, or the like, can be printed on opposite sides of the base 12, sides 22, 30 and bottom 26 and allow the ultimate user to assemble the holder 10 in the desired configuration. This may be particularly well suited for marketing the holder 10 in association with promoting existing rivelries (e.g. college football's annual Army-Navy game) or significant events (e.g., Superbowl, World Series, All Star Game, etc.).

Figure 4:
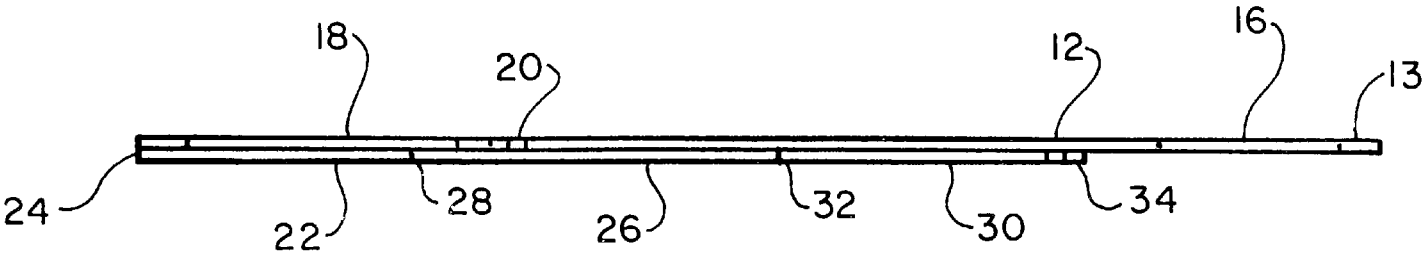
FIG. 4 is a side view of the holder illustrated in FIG. 3.
Figure 6:
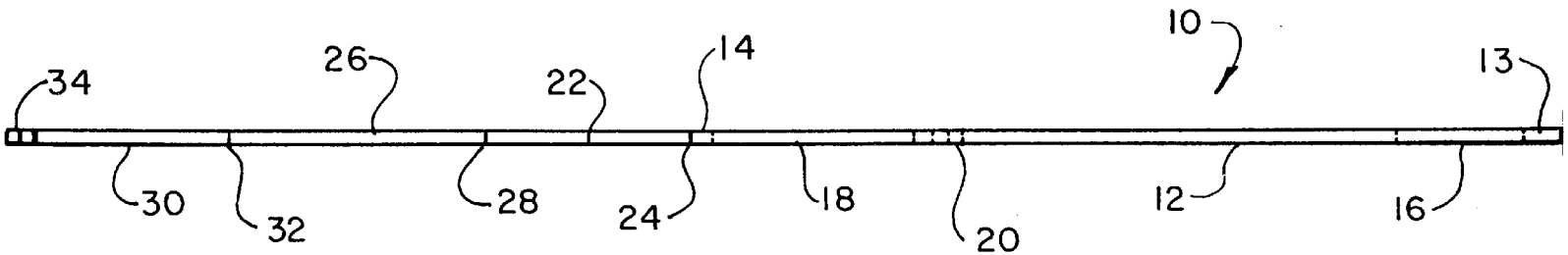
FIG. 6 is a side view of the holder illustrated in FIG. 5.

The assembly of the holder 10 is exceptionally simple from either the unassembled state shown in FIGS. 5 and 6 or the stored position shown in FIGS. 3 and 4. From either position, the user simply positions the sides 22 and 30 parallel to each other and perpendicular to the base 12 such that the bottom 26 is parallel to the base 12 and opposed from the opening aperture 18. The T-shaped tab 34 is inserted through the locking notch 20 and snapped into the neck receiving position as is well-known in the art. It is anticipated that any type of attachment mechanism may be utilized for securing the second side 30 to the base 12. The T-shaped tab 34 and locking notch 20 is merely a representative example. Once in the assembled position illustrated in FIGS. 1 and 2, the mounting end 13 can be slid into position under a couch or seat cushion or beneath a mattress leaving the beverage receiving aperture 18 protruding therefor for receipt of a bottle, can, glass, or the like, therein. In operation, the beverage container is received within the aperture 18 and supported on the bottom 26. The sides of the aperture 18 prevent the beverage container from moving out laterally of the holder 10. The weight of the seat cushion, couch cushion or mattress and/or the user thereon on the mounting end 13 of the base 12 will hold the beverage holder securely in position. It can be easily understood that the beverage holder 10 can be easily slid out and removed, stored for reuse, or the like.

It will be obvious to those of ordinary skill in the art that various modifications may be made to the present invention without departing from the spirit and scope thereof. For example, the base 12, sides 22, 30 and bottom 26 may be made wider to accommodate a plurality of apertures 18 in a side-by-side relationship. Additionally, a plurality of apertures 18 can be provided along the length of the base 12 between the notch 20 and the hinge 24. A plurality of apertures 18 may be provided of different sizes such that one size accepts conventional cans and one size accepts conventional bottles. Consequently, it will be understood that the illustrated example is only representative of, and not restrictive of, the present invention. The scope of the present invention is intended to be defined by the appended claims and equivalents thereto.

What is claimed is:

1. A collapsible beverage container holder comprising:

a) a planar base extending along a plane longitudinally from a terminal mounting end to a distal end, at least one beverage receiving aperture in said base adjacent to said distal end, wherein the beverage receiving aperture is adapted to receive a beverage container extending through the plane of the planar base;

b) a first side pivotally attached to said distal end and adapted to be moved to an operative position extending away from said planar base;

c) a bottom pivotally attached to an end of said first side and adapted to be moved to an operative position opposed from said at least one beverage receiving opening;

d) a second side pivotally attached to an end of said bottom adapted in operation to be attached to said base at a position between said mounting end and said at least one beverage receiving opening, wherein the holder has no other members extending from the planar base between the terminal mounting end and the attachment of the second side so that in operation the mounting end of the base is adapted to be positioned beneath a hold down member.

2. The holder of claim 1 wherein said base, said side and said bottom are formed from a single blank as a one piece integral member.

3. The holder of claim 1 wherein said base, said side and said bottom are movable from a planar stored position having said second side and said bottom opposed to said base.

4. The holder of claim 1 wherein each said beverage receiving aperture is sized to accommodate a conventional beverage container.

5. The holder of claim 1 wherein at least one of said base, said sides and said bottom includes printed indicia on at lest one surface thereof.

6. The holder of claim 1 wherein said printed indicia is on opposite surfaces of at least one of said base, said sides and said bottom.

7. The holder of claim 1 wherein said first side is adapted to be moved to said operative position substantially perpendicular to said base.

8. The holder of claim 1 wherein said bottom is adapted to be moved to said operative position substantially parallel to said base.

9. The holder of claim 1 wherein said hold down member is a seat cushion.

10. The holder of claim 1 wherein said holder is sized to fit in a conventional beverage container packaging case.

11. The holder of claim 1 further including a handle formed in said base.

* * * * *